US010932969B2

(12) United States Patent
Lingegård

(10) Patent No.: US 10,932,969 B2
(45) Date of Patent: Mar. 2, 2021

(54) INDICATOR DEVICE

(71) Applicant: Arjo IP Holding AB, Malmo (SE)

(72) Inventor: Hans Lingegård, Eslov (SE)

(73) Assignee: Arjo IP Holding AB, Malmo (SE)

( * ) Notice: Subject to any disclaimer, the term of this patent is extended or adjusted under 35 U.S.C. 154(b) by 0 days.

(21) Appl. No.: 15/780,848

(22) PCT Filed: Dec. 2, 2016

(86) PCT No.: PCT/EP2016/079689
§ 371 (c)(1),
(2) Date: Jun. 1, 2018

(87) PCT Pub. No.: WO2017/093549
PCT Pub. Date: Jun. 8, 2017

(65) Prior Publication Data
US 2018/0353358 A1 Dec. 13, 2018

Related U.S. Application Data

(60) Provisional application No. 62/263,032, filed on Dec. 4, 2015.

(51) Int. Cl.
*A61G 7/05* (2006.01)
*A61G 7/012* (2006.01)

(52) U.S. Cl.
CPC ..... *A61G 7/05* (2013.01); *A61G 7/012* (2013.01); *A61G 2203/12* (2013.01); *A61G 2203/20* (2013.01); *A61G 2203/30* (2013.01)

(58) Field of Classification Search
CPC ..... A61G 7/05; A61G 7/012; A61G 2203/30; A61G 2203/12; A61G 2203/20
USPC ..... 340/573.1
See application file for complete search history.

(56) References Cited

U.S. PATENT DOCUMENTS 5,349,340 A * 9/1994 Blumenthal ..... G08B 7/06 340/309.4
2006/0049936 A1* 3/2006 Collins, Jr. ..... A61G 7/0527 340/539.11
2007/0296600 A1* 12/2007 Dixon ..... A61G 7/05 340/573.1
2009/0119843 A1* 5/2009 Rodgers ..... A61G 7/0509 5/611
2011/0030141 A1* 2/2011 Soderberg ..... A61B 5/4839 5/600

(Continued)

FOREIGN PATENT DOCUMENTS

EP 2918255 A1 9/2015
JP 2008282219 A 11/2008

(Continued)

*Primary Examiner* — Hirdepal Singh
(74) *Attorney, Agent, or Firm* — The Webb Law Firm

(57) ABSTRACT

An apparatus has a patient care apparatus, a sensor disposed at the patient care apparatus, and an indicator device mountable to the patient care apparatus. The indicator device has an input device that inputs a patient type to the indicator device and an indicator that outputs a status to a user. The indicator outputs the status to the user based on the patient type and a configuration of the patient care apparatus sensed by the sensor. The patient care apparatus is selected from the group consisting of: a bed, a patient lift or hoist, a patient trolley and a patient standing aid.

23 Claims, 4 Drawing Sheets

(56) References Cited

U.S. PATENT DOCUMENTS

| | | | | |
|---|---|---|---|---|
| 2011/0169653 | A1* | 7/2011 | Wang | A61G 7/005 340/686.6 |
| 2011/0205061 | A1* | 8/2011 | Wilson | G05B 19/042 340/573.1 |
| 2011/0231996 | A1* | 9/2011 | Lemire | A61G 7/0524 5/613 |
| 2012/0025991 | A1 | 2/2012 | O'Keefe et al. | |
| 2014/0039351 | A1* | 2/2014 | Mix | A61B 5/1114 600/587 |
| 2014/0313700 | A1 | 10/2014 | Connell et al. | |
| 2014/0324315 | A1 | 10/2014 | Brondum | |
| 2015/0107020 | A1* | 4/2015 | Andersson | A61G 7/1015 5/83.1 |
| 2015/0257952 | A1* | 9/2015 | Zerhusen | A61G 7/051 340/12.5 |
| 2016/0331614 | A1* | 11/2016 | Furman | A61G 7/018 |
| 2017/0020756 | A1* | 1/2017 | Hillenbrand, II | A61B 5/6891 |
| 2017/0124844 | A1* | 5/2017 | Huster | A61G 7/0524 |
| 2019/0008708 | A1* | 1/2019 | Moreno | G06F 19/00 |

FOREIGN PATENT DOCUMENTS

| | | | |
|---|---|---|---|
| JP | 201240146 | A | 3/2012 |
| JP | 2013144045 | A | 7/2013 |
| JP | 2014233490 | A | 12/2014 |
| JP | 2014533217 | A | 12/2014 |
| WO | 2007075701 | A2 | 7/2007 |
| WO | 2012122002 | A1 | 9/2012 |
| WO | 2015138929 | A1 | 9/2015 |

* cited by examiner

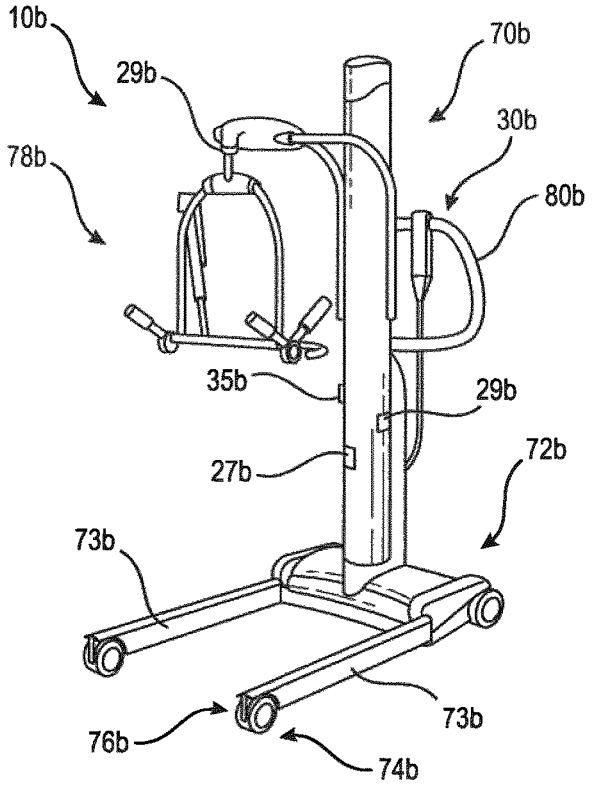
FIG. 6
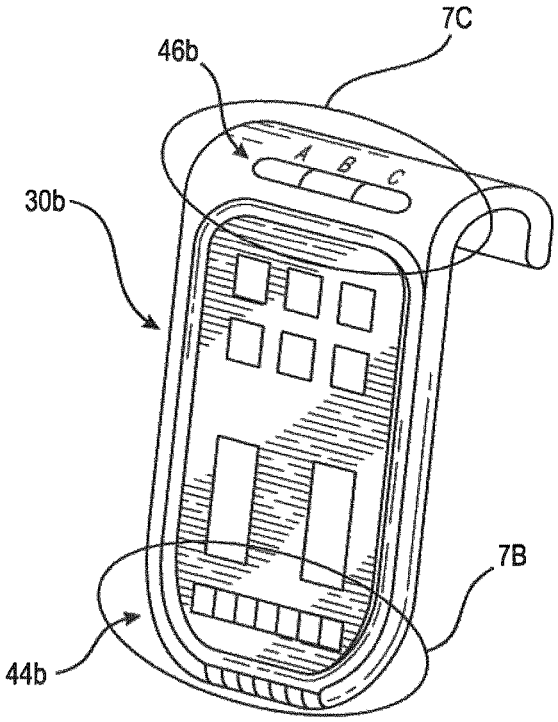
FIG. 7A
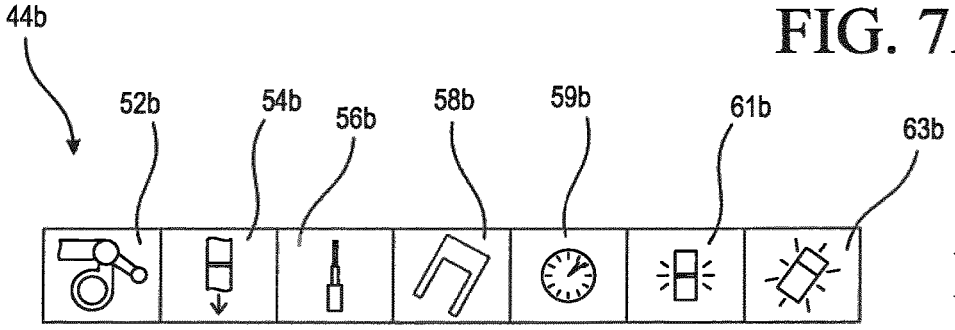
FIG. 7B
FIG. 7C
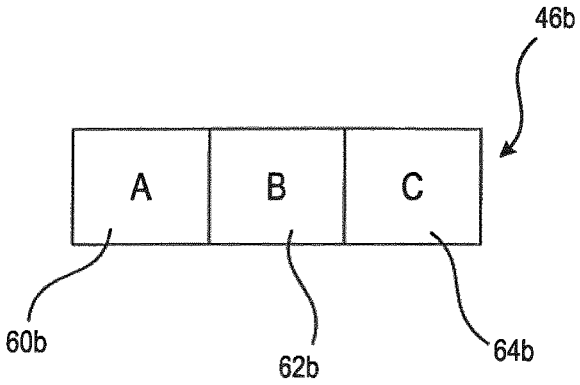

INDICATOR DEVICE

CROSS-REFERENCE TO RELATED APPLICATIONS

This application is the United States national phase of International Application No. PCT/EP2016/079689 filed Dec. 2, 2016, and claims priority to U.S. Provisional Patent Application No. 62/263,032 filed Dec. 4, 2015, the disclosures of which are hereby incorporated in their entirety by reference.

BACKGROUND OF THE INVENTION

Technical Field

The present disclosure is directed to a system or device for monitoring the configuration of equipment such as, for example, hospital equipment.

Description of Related Art

Hospital equipment is often adjustable to conform to the individual attributes of a given patient or use. For example, a hospital bed may be adjustable to help move a patient into or out of a bed or have handles that may be configured to assist in the movement of patients. Also for example, a hospital bed may be configured to maintain a patient in the bed during periods when the patient is unattended, e.g., during the night. Other equipment such as various types of hospital furniture may be similarly adjustable.

To monitor a patient's interaction with equipment during periods when the patient is unattended, such as during the night or during periods when hospital personnel are not in a room with a patient, equipment may include monitoring devices to identify unsuitable equipment configurations. For example, a hospital bed may include a device to identify generally unsuitable configurations for the bed.

Conventional systems, however, typically do not provide sufficient information regarding patient use of equipment to attending staff. For example, in the case of a hospital bed, conventional indicators do not provide a care worker with sufficient information regarding hospital equipment with respect to varying conditions of various patient types such as, for example, information regarding both more able and less able patients.

The present disclosure is directed to overcoming the problems set forth above.

SUMMARY OF THE INVENTION

In one exemplary embodiment of the present disclosure, an apparatus includes a patient care apparatus, a sensor disposed at the patient care apparatus, and an indicator device mountable to the patient care apparatus. The indicator device has an input device that inputs a patient type to the indicator device and an indicator that outputs a status to a user. The indicator outputs the status to the user based on the patient type and a configuration of the patient care apparatus sensed by the sensor.

In another exemplary embodiment, the present disclosure is directed to a patient handling apparatus including one or more sensors detecting a configuration of the patient handling apparatus and an indicator device operatively associated with the one or more sensors. The indicator device may include a user interface allowing input of patient type information, and an indicator that issues a status notice based on the entered patient type information and the detected configuration of the patient handling apparatus sensed by the one or more sensors.

In one embodiment, the above referenced apparatus and/or patient handling apparatus may be configured as portable, hand held device detachably coupled to one or more portions of the patient handling apparatus. For example, the indicator device may include an adjustable hook that can be detachably mounted to multiple portions of the patient handling apparatus. The indicator device may be wirelessly coupled or connected by a cable to the one or more portions of the patient handling apparatus.

In one embodiment, the patient type information is a stable patient type or an unstable patient type. The patient type information may relate to a degree and/or level of patient mobility. Additionally, a resultant status and/or status notice may be a suitable-for-patient status or an unsuitable-for-patient status.

In one embodiment, the indicator is a system status indicator that provides a status notice of the patient handling system. The system status indicator may be configured as a light element and/or an audio device. The system status indicator may be configured as one or more light elements disposed at a distal end of the indicator device and are oriented and configured to direct emitted light towards the ground for reflection.

In one embodiment, the apparatus and/or patient handling apparatus may further include a plurality of casters and one or more brakes selectively braking the plurality of casters. At least one of the sensors may detect whether the plurality of casters are locked by the one or more brakes, and the indicator may be a brake indicator that issues a brake status notice.

In one embodiment, the indicator may be a power source status indicator that indicates a status of a power source of the patient handling apparatus.

In one embodiment, the apparatus and/or patient handling apparatus may be a bed, a patient lift, a patient trolley and a patient standing aid. When configured as a bed, the apparatus may include a power source sensor for detecting the amount of battery life or other power available; a bed height positioning sensor for detecting whether the bed is in a raised, lowered or middle position; a siderail positioning sensor for detecting whether one or more siderails are in a raised, lowered or middle position; a brake sensor for detecting whether one or more wheels or casters of the bed are in a locked or braked position; a backrest positioning sensor for detecting whether the backrest section of the bed is in a horizontal or elevated position or to detect the backrest angle of positioning; a mattress pressure sensor for detecting the pressure in the mattress and/or any section or portion thereof (e.g. pressure in one or more inflatable cells or inflatable sections of the bed); a patient support air flow sensor for detecting the rate of air flow through a patient support; an inflatable mattress therapy sensor for detecting when alternating pressure therapies and/or percussion therapy is being provided; bed egress or exit sensor for detecting if a patient has or is about to leave the bed; bed adjustment sensor for determining when a the position of the bed is being actively altered (e.g. raising of the backrest or placement in a CPR position); and/or any combination thereof. The indicator device may include one or more component indicators corresponding to various sensors (e.g. displays or indicators for: power source availability; elevated, lowered or middle bed height; raised, lowered or middle siderail positioning; unlocked or applied brakes for a bed's wheels/castors; raised or lowered backrest; under inflated and/or excess pressure in one or more sections of a mattress such as a seat section; excess or slow air flow through a patient support; active or inactive therapy delivered by an inflatable mattress; whether the bed is in the process of being adjusted to assume different positions; determining if patient has existed or is leaving the bed; etc). When configured as a patient lift, the apparatus may include a power source sensor for detecting a battery life or other power available, sling attachment sensor for detecting if a patient sling is secured to a patient hoist, load sensor for detecting the presence of a patient, a brake sensor for detecting whether one or more wheels or casters of the patient lift are in a locked or braked position, a sling positioning sensor for detecting an appropriate height of a sling or the appropriate positioning of a patient within a sling and/or any combination thereof. The indicator device may include one or more component indicators corresponding to various sensors (e.g. displays or indicators for: power source availability; unlocked or applied brakes for a bed's wheels/castors; sling attachment or securement; detection of patient's weight or presence in a sling; and/or the appropriate and/or inappropriate height of a sling; appropriate and/or inappropriate positioning of a patient within a sling; etc.).

In one embodiment, the indicators may be configured as light elements that emit light when a detected feature of the patient handling apparatus is in an undesired state for the entered patient type information. The light elements may be disposed at a distal end of the indicator device. They may also be oriented and configured to direct emitted light towards the ground for reflection.

In another exemplary embodiment, the present disclosure is directed to a bed system. The bed system includes a bed, a sensor disposed at the bed, and an optional actuator disposed at the bed. An indicator device is mountable to the bed. The indicator device has an input device that inputs a patient type to the indicator device and an indicator that outputs a status to a user. The indicator outputs the status to the user based on the patient type and a configuration of the bed that is actuated by the actuator and sensed by the sensor.

In one embodiment, the actuator may be used to adjust an angle of an upper portion of the bed from a horizontal plane. The sensor may sense the angle of the upper portion of the bed from the horizontal plane, and the indicator is a bed inclination indicator. The actuator may alternatively, adjusts a height of the bed from a floor, and the sensor may senses the height of the bed from the floor. The patient type may be an all-patient type, a stable patient type, or an unstable patient type.

In one embodiment, the bed system further may include a side rail disposed on the bed. The sensor senses whether or not the side rail is raised in an upright position, and the indicator is a side-panel position indicator. The sensor may also detect if a patient has exited the bed when the indicator is a patient-exit indicator.

In one embodiment, a first light unit may be disposed on the indicator device and a second light unit may be included in the indicator. The first light unit and the indicator may illuminate in a first color indicating a suitable-for-patient status or in a second color indicating an unsuitable-for-patient status.

In one exemplary embodiment of the present disclosure, a hoist system includes a patient hoist and a sensor disposed at the patient hoist. The hoist system may further include an indicator device mountable to the patient hoist, the indicator device having an input device that inputs a patient type to the indicator device, and an indicator that outputs a status to a user. The indicator may output the status to the user based on the patient type and a configuration of the patient hoist that is sensed by the sensor.

In one embodiment, the hoist system of further includes a patient support interface removably attachable to a mast of the patient hoist. The sensor senses whether a patient is loaded on the patient support interface, and the indicator is an interface-loaded indicator. The hoist system may further include a patient support interface removably attachable to a mast of the patient hoist. The sensor may sense whether the patient support interface is attached to the mast, and the indicator is an interface-connected indicator. The patient hoist may also include a height-adjustable mast, wherein the sensor senses a height of the mast and the indicator is a mast-height indicator. The patient hoist can further includes a chassis having a plurality of stabilizing legs, wherein the sensor senses whether or not the stabilizing legs are in a locked position, and the indicator is a chassis-legs-locked indicator. The hoist system may also have a plurality of casters attached to the patient hoist and a plurality of brakes selectively braking the plurality of casters. The sensor senses the time period during which the patient hoist is in a stationary position with the casters not being locked by the plurality of brakes, and the indicator is a standstill-time indicator.

BRIEF DESCRIPTION OF THE DRAWINGS

FIG. 6 is a perspective view of an exemplary system;

FIG. 7A is a perspective view of the exemplary indicator device of FIG. 6;

FIG. 7B is a schematic view showing exemplary indicators of the exemplary indicator device of FIG. 7A; and FIG. 7C is a schematic view showing exemplary input devices of the exemplary indicator device of FIG. 7A.

DETAILED DESCRIPTION

Figure 1A:
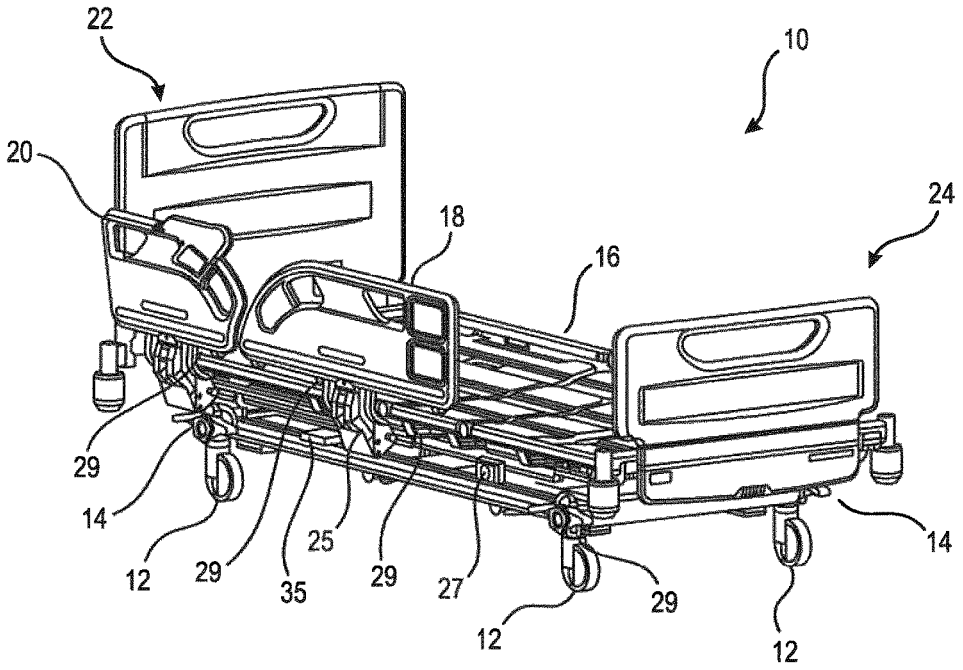
FIG. 1A is a perspective view of an exemplary system.

FIG. 1A illustrates an exemplary system 10. System 10 may be any suitable equipment system for a hospital or similar facility (e.g., a long term care facility, a nursing home, a residence, a rehabilitation facility, or a psychiatric facility) such as, for example, a patient care apparatus, patient handling equipment, patient transfer apparatus and systems, a hospital bed, long term care beds, a patient lifter, standing aids, or other hospital furniture such as a patient examining chair, furniture for use in a medical procedure, a restraining device for a patient, a physical therapy device, or any other suitable hospital, rehabilitation, and/or long term care equipment. System 10 may include a plurality of adjustable features for patient comfort.

Figure 1B:
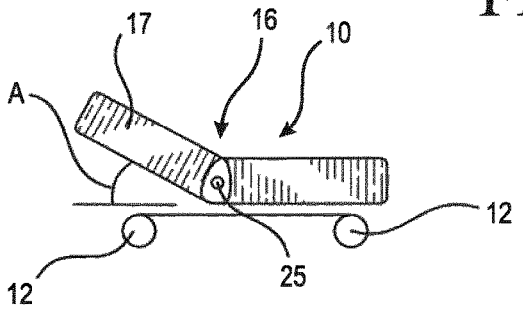
FIG. 1B is a schematic view of an exemplary system.

System 10 may include a plurality of casters 12 that may be locked by one or more brakes 14, respectively. System 10 may also include a frame 16. Frame 16 may be any suitable frame such as, for example, a height adjustable frame for raising and lowering the bed and a patient supported thereon. For example, frame 16 may be a bed frame such as, for example, a hospital bed frame or a frame for a long term care bed. Also, for example, frame 16 may be a bed frame that is selectively adjustable between a substantially horizontal position and an inclined position. For example, an upper portion of frame 16 corresponding to an upper portion of a patient's body, (e.g. backrest or torso portion of the bed frame), may be selectively raised so that an upper portion of frame 16 may be inclined from a horizontal plane (e.g., so that an upper portion of a patient's body may be inclined such as, for example, for patients for whom remaining in a horizontal position is unsuitable). As schematically illustrated in FIG. 1B, an upper portion 17 of frame 16 may be inclined at any suitable angle "A" from a horizontal position such as, for example, between about 20 degrees and about 40 degrees, or e.g. about 30 degrees. In one embodiment, system 10 may be a bed or mattress with multiple patient support sections (e.g. head/back rest section, seat section, leg section and foot section) and/or multiple corresponding sections of bed frame 16, one or more or all of which may be movably adjustable relative to one another, thus for example, allowing a back rest section to pivot and move between a substantially horizontal to a substantially, vertical seated position and various inclined angles therebetween. In another embodiment, system 10 may include an inflatable mattress with multiple inflatable cells and/or multiple inflatable bed sections for support a patient. Referring back to FIG. 1A, system 10 may also include a first set of side rails 18 (e.g., panels) that may be moveable between upper and lower positions and/or a middle position. System 10 may also include a second set of side rails 20 that may be disposed at either side of system 10. For example, one or more side rails 20 may be disposed at a patient head end of system 10 (e.g., in the case that system 10 is a hospital bed or a bed for a similar facility such as the ones disclosed above). Side rails 20 may also be movable between a lower position and an upper raised position as illustrated in FIG. 1A. In one embodiment, side rails 20 may also be movable between a raised uppermost position, middle/mid-raised position and lower position. Side rails 18 and side rails 20 may be used, for example, to secure and maintain a patient safely on an upper surface of system 10.

System 10 may also include a headboard 22 and a foot rest 24 (for example, when system 10 is a hospital bed or other similar type of hospital equipment or equipment, e.g., for long term care or physical rehabilitation). Headboard 22 and foot rest 24 may be substantially stationary (e.g., not movable or configurable). It is also contemplated that system 10 may also have movable and/or configurable headboards and/or foot rests.

System 10 may include electrically, hydraulically, and/or pneumatically operated actuators 25 and 27. For example, actuators 25 and 27 may be integrated as part of frame 16 and/or side rails 18 and 20, or provided externally to one or more elements of system 10. Actuators 25 and 27 of system 10 may facilitate an operation of system 10. For example, actuators 25 and 27 may operate to adjust a height of system 10 and/or a position of side rails 18 and/or side rails 20. For example, as illustrated in FIG. 1B, actuator 25 may selectively control an inclination of system 10, and may move upper portion 17 to be at a desired angle "A" from a horizontal plane (e.g., a substantially flat floor). Actuators 25 and 27 may be any suitable actuators for adjusting equipment. In another exemplary embodiment, actuators 25 (e.g. pump, exhaust and/or valve actuators) may control inflation and/or deflation of one or more inflatable cells and/or inflatable sections of a mattress.

System 10 may include a plurality of sensors 29 for sensing and detecting the position and/or properties of system 10 and its components. For example, sensors 29 may sense a position of casters 12, brakes 14, frame 16, bed side rails 18 and/or side rails 20. In one embodiment, one or more sensors 29 maybe positioned to detect whether casters 12 are raised or lowered, the locked or unlocked position and/or state of brakes 14, the height of bed frame 16 and/or the position of one or more sections of a bed or bed frame 16 (e.g. lowered or elevated backrest section, seat section, leg section and/or foot section), and the elevated and/or lowered position of side rails 18, 20. In another embodiment, sensors 29 may be used to provide information regarding a state of operation or a characteristic of a component of system 10, such as the inflated and/or deflated state, degree of inflation and/or deflation, the rate of inflation and/or deflation of a mattress or portion thereof (e.g. select inflatable cells of a mattress, turning bladders, backrest section, seat section, leg section and/or foot section), rate of air flow through a mattress or coverlet, etc. Sensors 29 may be any suitable device for sensing a position and/or operation of elements of system 10 such as, for example, an active transducer, a passive transducer, a pressure sensor, magnet and hall sensors, and/or a bidirectional sensor. Sensors 29 may be disposed at one or more locations of system 10 so as to provide measurements and other information, for example, for use in providing a medical professional or other caregiver data used for ascertaining a configuration of system 10. For example, sensors 29 may provide output that may be used to notify personnel of either suitable or unsuitable configurations of system 10 in relation to various patients.

Figure 2:
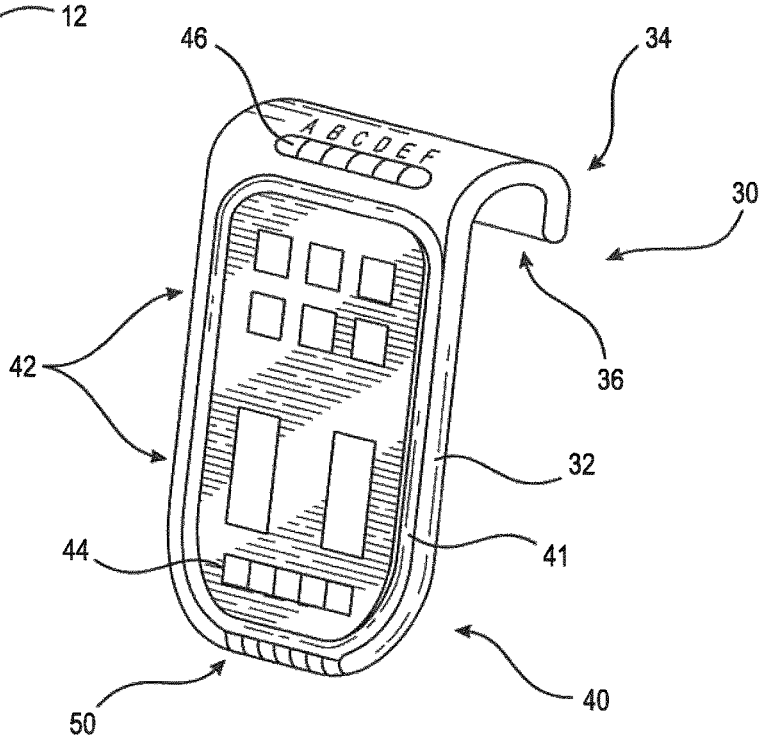
FIG. 2 is a perspective view of an exemplary indicator device.

FIG. 2 illustrates an exemplary indicator device 30. Indicator device may be any suitable device for providing information (e.g., output from sensors 29 and/or other sources) as to a configuration of system 10. For example, as illustrated in FIG. 2, indicator device 30 may be a configuration indicator for providing an indication of the state of configuration of system 10 such as, for example, a hospital bed indicator, patient support indicator, a patient handling equipment indicator, a hospital furniture indicator, a patient transfer system indicator, a patient lifter and/or hoist indicator, or any other suitable type of indicator used in a hospital or similar facility (e.g., for equipment used for physical rehabilitation, long term care, psychiatric care, or a residence). Indicator device 30 may include a housing 32 (e.g., any suitable housing or casing for an indicator device). Housing 32 may include an attachment portion 34, which may for example be a separate component or an integral part of housing 32. For example, attachment portion 34 may be formed integrally with housing 32 as a part of the housing 32 itself. Attachment portion 34 may be, for example, a hook, clamp, clasp, snap, magnet, opening, connector, or other element suitably structured to be mounted on system 10 for attaching indicator device 30 to a portion of system 10. Attachment portion 34 may include a hook or other opening 36 that is wide enough to accommodate a portion of the various elements of system 10. For example, attachment portion 34 may be dimensioned to fit a width of a portion of frame 16, a rail attached to system 10, a portion of foot rest 24, a portion of headboard 22, and/or a portion of side rails 18 and 20. Attachment portion 34 may be, for example, adjustable to fit varying dimensions of different portions of system 10. For example, attachment portion 34 may be an adjustable hook. In an exemplary embodiment, indicator device 30 and housing 32 may be portable. For example, housing 32 may be sized so that it can be held and easily carried or moved by hand by a user. For example, housing 32 may be about the size of a person's hand or may be sized to be larger than a user's hand (but may still be, for example, portable). It is also contemplated that in one embodiment, housing 32 may be substantially stationary (for example, substantially fixed in place at a given location of system 10).

Indicator device 30 may be operatively associated with and sensors 29, and/or controller 35 and/or system 10. In one embodiment, indicator device 30 may include a coupling element that couples indicator device 30 electrically to sensors 29 and/or a controller 35. Controller 35 may be any suitable control device for controlling operation of system 10 such as, for example, a control device including a central processing unit and other suitable elements for receiving input and generating output (e.g., a processing unit or any other suitable type of automated and/or computer controller for facilitating automated control). Controller 35 may be disposed at a portion of system 10 such as, for example, at frame 16 or any other suitable location of system 10. Indicator device 30, sensors 29, and controller 35 may be coupled by any suitable technique such as, for example, a wireless coupling (e.g., one including a transceiver) or a cable such as for example, an electrical cable. For example, indicator device 30 and sensors 29 may be coupled via electrical lines to controller 35 that is disposed on frame 16. For example, indicator device 30, sensors 29, and controller 35 may be coupled by a cable connection that may reduce an amount of wireless noise that might potentially interfere with other equipment disposed in a vicinity of system 10. Also, for example, indicator device 30, sensors 29, and controller 35 may be coupled by any suitable technique for ensuring a reliable link between sensors 29, indicator device 30, and controller 35.

Housing 32 may have any suitable structure or size for allowing indicator device 30 to be moved by personnel using system 10 (e.g., medical personnel or other care givers) and placed in positions on system 10 that may be convenient for attending personnel and may be seen when a patient is left alone (e.g., during a period when a patient may be resting or sleeping). For example, indicator device 30 may be positioned at or near a location of system 10 that is close to a doorway or facing a front portion of a screen or other device for providing privacy (e.g., a curtain, divider, or other device affording privacy to a patient or other user of system 10). Also, for example, indicator device 30 may be placed at any location of system 10 visible to attending personnel such as, for example, frame 16, side rails 18, side rails 20, headboard 22, foot rest 24, handle or any other suitable location of system 10. In one embodiment, indicator device 30 may be coupled to, latch on, hang on an edge or upper surface of frame 16, side rails 18, side rails 20, headboard 22, foot rest 24, handle or exposed ledge of system 10.

Indicator device 30 may include one or more light units 40. Light unit 40 may be used to indicate a state of configuration of system 10. Light unit 40 may include a first indicator element 41 that may be an integral portion of housing 32 or a separate component that encircles first display elements 42 and second display elements 44 (or a single display element or any other suitable number of display elements) at a front and/or a rear side of housing 32. In one embodiment, first indicator element 41 is configured as a lighting element, such as LED lights and/or other light source, and may be illuminated when indicator device 30 is in operation. For example, first element 41 may project different colors or flashing colors corresponding to different states of system 10, clearly notifying a user as to a state of system 10 and/or communicating alarm notices/alerts. In one embodiment, first indicator element 41 may encircle one or more display elements 42, 44 forming a single display. In one embodiment, the display elements 42, 44 may include and/or may be configured as, for example, one or more display screens and/or any suitable number of LEDs, lamps or other light elements and sources for illumination elements or surfaces disposed in any suitable arrangement for providing notification to attending personnel. Light unit 40 may also include a second indicator element 50 that may be an integral portion of housing 32 or a separate component that is disposed at a bottom portion of housing 32. Second indicator element 50 may be configured to direct light generated by light unit 40 downwardly when indicator device 30 is in use. For example, in one embodiment, second indicator element 50 may be configured as a lighting element, such as LED lights or other light source. In one embodiment, the display, display elements, first indicator element 41 and/or second indicator element 50 may include and/or may be configured as lighting elements which illuminate, project colored and/or flashing lights to notify a user as to a state of system 10 and/or alert/alarm condition; these display, display elements and/or first indicator element 41 may coordinate light projections, simultaneously project light and/or may independently project light relative to one another.

Indicator device 30 may also include an input unit 46. Input unit 46 may be any suitable unit for a user of indicator device 30 to provide input, such as system 10 and/or patient data, to indicator device 30 such as, for example, a button console, a keypad, a touchscreen, or any other suitable unit for receiving data from a user based on tactile, visual, audio, or any other suitable technique for providing input.

As discussed above, light unit 40 may include one or more or a plurality of LEDs, lamps or other light elements and sources. These light sources of light unit 40 may be operated in a plurality of modes. For example, light unit 40 may operate to indicate a suitable and/or unsuitable configuration of system 10 (e.g., a suitable-for-patient status or an unsuitable-for-patient status). For example, light unit 40 may be formed of one or more LEDs, lamps or other light elements and sources. Also for example, light unit 40 may generate light of any suitable wavelength such as, for example, a plurality of different colors including red, orange, yellow, green, blue, violet, and white. For example, light unit 40 may include a plurality of lights including green, yellow, amber, and or red lights. The lights may also be able to flash and project lights of different patterns.

Light unit 40 may be configured in any suitable shape or configuration such as, for example, a square pattern, a circular configuration, a linear configuration, a striped configuration, and/or a polygonal shape. Light unit 40 may include one or more LEDs, lamps, light elements or sources configured to direct light downwardly (with respect to a longitudinal direction of indicator device 30, such as in a direction moving away from element 50) from at least one light element. Light unit 40 may include one or more LEDs, lamps and light elements configured to direct light in a lateral direction from the sides of indicator device 30 in a sideways direction, upward from indicator device 30, frontwards (e.g., forwardly) from indicator device 30, rearwards from indicator device 30, diagonally from indicator device 30, or any other suitable direction from indicator device 30. For example, light unit 40 may be configured to direct light sideways and/or upwardly from indicator device 30, and/or frontwards and/or downwards.

Figure 3A:
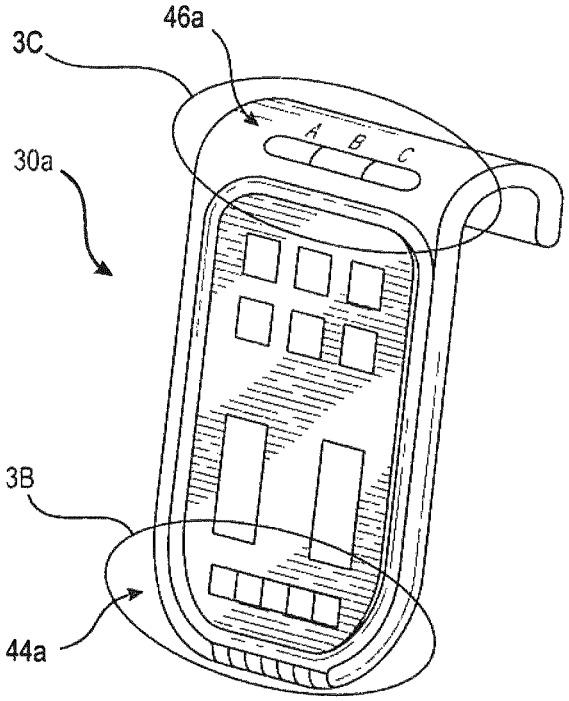
FIG. 3A is a perspective view of an exemplary indicator device.
Figure 3B:
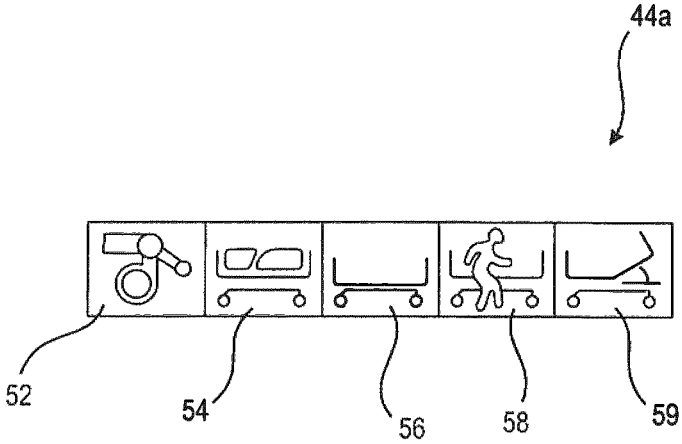
FIG. 3B is a schematic view showing exemplary indicators of the exemplary indicator device of FIG. 3A.

FIG. 3A illustrates an exemplary embodiment of an indicator device. Indicator device 30*a* may be generally similar to indicator device 30. Indicator device 30*a* may include a second display element 44*a* and an input unit 46*a* that may be the same or generally similar to second display element 44 and input unit 46, respectively. Indicator device 30*a* may be an exemplary indicator device for a bed (e.g., for use in a hospital, physical therapy center, long term care facility, residence, psychiatric care center, rehabilitation center, and/or any other suitable location for providing an indicator device for a bed). As illustrated in FIG. 3B, second display element 44*a* may include a brake indicator 52 that may illuminate when brakes are applied (e.g., when brakes 14 are applied), a side-panel position indicator 54 that may illuminate when side panels are raised and/or lowered (e.g., when side rails 18 and/or side rails 20 are raised), a bed height indicator 56 that may illuminate when the bed/system 10 is in a raised and/or lowermost position (e.g., when frame 16 is in an uppermost and/or lowermost position), a patient-exit indicator 58 that may illuminate when system 10 is in a configuration in which a user may exit and/or step off of system 10 (e.g., in the case that system 10 is a bed, patient-exit indicator 58 may indicate that it is a suitable time for a patient to leave the bed, for example when frame 16 is in its lowest position and side rails 18, 20 are in their lowered positions) or that a patient has actually exited system 10 (e.g., sensor 29 may be a pressure sensor or any other suitable sensor for detecting that a patient has exited system 10), and a backrest-inclination indicator 59 (e.g., a bed inclination indicator) that may indicate when frame 16 is in an angled configuration exceeding a predetermined threshold (e.g., when a portion of frame 16 corresponding to an upper portion of a patient's body is angled greater than a threshold angle from a horizontal plane such as, for example, 30 degrees, 35 degrees, 25 degrees, or 20 degrees). Brake indicator 52, side-panel position indicator 54, bed height indicator 56, patient-exit indicator 58, and/or backrest-inclination indicator 59 may provide attending personnel (e.g., a nurse or other care personnel) with an indication of the state of each of the configurable elements of system 10 (e.g., with respect to the activities of a patient or other user of system 10). Brake indicator 52, side-panel position indicator 54, bed height indicator 56, patient-exit indicator 58, and/or backrest-inclination indicator 59 may provide output based on a configuration of system 10 sensed by one or more sensors 29 and a patient type input to input unit 46*a* as described below. In other embodiments, indicator device 30*a* may also include a mattress inflation and/or deflation indicator providing a user with an indication of mattress pressure in one or more sections of the mattress (e.g. seat section of the mattress) or the rate of inflation/deflation of one or more mattress sections; patient turning indicators to provide notice when turning bladders are activated to assist with turning of a patient; and/or air flow indicator for determining the rate of air flow through a mattress (such as a low air loss mattress) or coverlet.

Figure 3C:
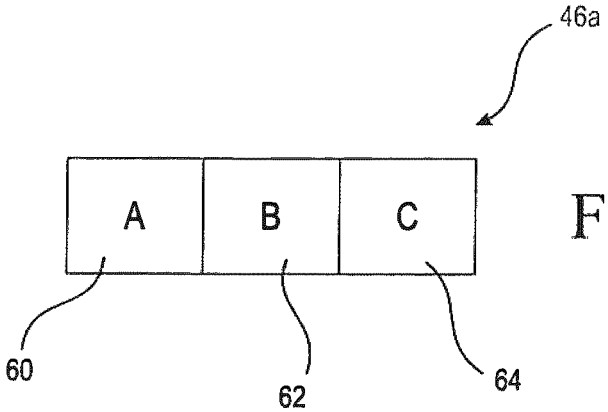
FIG. 3C is a schematic view showing exemplary input devices of the exemplary indicator device of FIG. 3A.

As illustrated in FIG. 3C, input unit 46*a*, e.g. user interface, may include a first input device 60, a second input device 62, and third input device 64. Input devices 60, 62, 64 may be any suitable type of switch for allowing a user to input information to input unit 46*a* such as, for example, push-button switches, dials, levers, or touchscreen devices. First input device 60 may be used by an operator to set parameters for system 10 when system 10 is not being moved between different locations or positions (e.g., in the case when system 10 is substantially stationary such as, for example, when system 10 is a bed for accommodating a patient therein). For example, first input device 60 may be activated for a situation applicable to all users or patients (e.g., a universal setting, or an all-patient type setting). For example, when first input device 60 is activated, indicators 52, 54, 56, 58, and 59 may all illuminate to indicate a suitable condition (e.g., green) to attending personnel or may not be illuminated at all. Also, for example, when first input device 60 is activated, brake indicator 52 may illuminate as unsuitable (e.g., red or other color denoting unsuitability) when brakes 14 are off (e.g., and brake indicator 52 may illuminate as suitable when brakes 14 are on and system 10 is locked in a substantially stationary position).

Second input device 62 may be used by an operator to set system 10 into a configuration deemed suitable for a first category or type of user of system 10. For example, second input device 62 may be used to set system 10 into a configuration deemed suitable for a patient who is unlikely to fall out of system 10 unintentionally (e.g., a user who is in generally good or fair physical condition such as, for example, a patient who is sufficiently stable to be able to get into and out of system 10 unaided for the case in which system 10 is a bed, e.g., a stable patient type). For example, second input device 62 may allow for an indication of a suitable bed configuration even when one or more of the features of system 10 is disengaged, such as for example when side rails 18 and/or side rails 20 are in a lowered or disengaged position. For example, when second input device 62 is activated, brake indicator 52 may be illuminated to display an unsuitable configuration (e.g., red) when one or brakes 14 are unlocked (e.g., it may be deemed unsuitable for even healthy users to exit system 10 when the brakes are off), but may display a suitable configuration (e.g., green) when all of brakes 14 are locked. For example, when second input device 62 is activated, side-panel position indicator 54 may not be illuminated or may be illuminated to display a suitable configuration (e.g., green) when one or more side rails 18 and 20 are either in a raised or lowered position. Similarly, when second input device 62 is activated, bed height indicator 56 may not be illuminated or be illuminated to display a suitable configuration (e.g., green) when frame 16 is either in a raised or lowered position. It is also contemplated that when second input device 62 is activated and frame 16 is in a raised position, bed height indicator 56 may be illuminated to display an unsuitable configuration (e.g., red). Also for example, when second input device 62 is activated, patient-exit indicator 58 may not be illuminated or may remain in a suitable configuration (e.g., green illumination) deeming it suitable for healthy patients to climb on or off system 10 at any time. Further for example, when second input device 62 is activated, backrest-inclination indicator 59 may not be illuminated or may remain in a suitable configuration (e.g., green illumination) deeming it suitable for healthy patients to be at any suitable inclination angle "A" illustrated in FIG. 1B.

Third input device 64 may allow an operator to configure system 10 for a user generally associated with higher levels of instability and uncertainty (e.g., an unstable patient type). For example, third input device 64 may configure system 10 for use by a user who is relatively more likely than other users to fall out of system 10 unintentionally or who is otherwise too unstable to be able to get into or out of system 10 unaided. In a setting activated by third input device 64, system 10 may be deemed to be in a suitable configuration only when most or all of the features of system 10 are engaged (e.g., all of the features of system 10 designed to help maintain a user within or on system 10 are engaged such as, for example, side rails 18 and side rails 20 being in an upright and locked position). For example, when system 10 is a bed, all of the features of system 10 designed to maintain a patient in bed may be activated based on an operator activating third input device 64. Accordingly, when third input device 64 is activated, brake indicator 52 may be illuminated to be suitable (e.g., green) when brakes 14 are on but may be illuminated to be unsuitable (e.g., red) when brakes 14 are off, side-panel position indicator 54 may be illuminated to be suitable (e.g., green) when side rails 18 and 20 are in an upright position but may be illuminated to be unsuitable (e.g., red) when one or more side rails 18 and 20 are in an unlocked or lowered position, bed height indicator 56 may be illuminated to be suitable (e.g., green) when frame 16 is in a lowermost position but may be illuminated to be unsuitable (e.g., red) when frame 16 is in any position other than a lowermost position, and patient-exit indicator 58 may be illuminated to be unsuitable at any time that one or more sensors 29 detect that a patient is exiting or has exited system 10. Also, when third input device 64 is activated, backrest-inclination indicator 59 may be illuminated to be suitable (e.g., green) when angle "A" is equal to or greater than a predetermined value (e.g., about 30 degrees, about 25 degrees, about 35 degrees, or about 20 degrees) and may be illuminated to be unsuitable (e.g., red) when angle "A" is below the predetermined value (e.g., indicating to attending personnel that a patient should remain in an inclined position instead of a flat position).

First input device 60, second input device 62, and third input device 64 may be operatively associated with and/or operate in conjunction with controller 35, indicator device 30*a*, and/or sensors 29 to cause, for example, the LEDs, lamps or other light elements or sources of light unit 40 and second display element 44 to illuminate to indicate whether the bed is in the configuration suitable for meeting the respective criteria of first input device 60, second input device 62, and/or third input device 64. For example, when system 10 is deemed to be configured in an appropriate manner, light unit 40 may illuminate in a first mode (for example, light unit 40 may illuminate in green, white, purple, blue, or another predetermined color, or in a steadily-lit manner). Also, for example, when system 10 is deemed to be configured in an inappropriate manner, light unit 40 may illuminate in a second mode (for example, light unit 40 may illuminate in a different color, e.g. red, orange, yellow, or other predetermined color, or in a flashing manner). Further, for example, light unit 40 may be designed to illuminate in any manner that would intuitively notify attending personnel as to the status of the configuration of system 10 (for example, a red flashing mode of illumination may intuitively notify attending personnel of an inappropriate configuration of system 10, while a steady green mode of illumination may intuitively notify attending personnel of an appropriate configuration of system 10). Indicator device 30*a* may additionally include audio features to provide further notification to attending personnel in suitable situations. For example, when system 10 is employed in a facility for psychological treatment, indicator device 30*a* may include audio features that provide notification to attending personnel of an inappropriate configuration of system 10 (such as, for example, a high-pitched audio alert to notify attending personnel of an inappropriate configuration).

Display elements 42, 44, brake indicator 52, side-panel position indicator 54, bed height indicator 56, patient-exit indicator 58, and/or backrest-inclination indicator 59 may also be illuminated similarly as described above with reference to light unit 40. For example, brake indicator 52 may be illuminated when one or more brakes 14 have been applied. Also, for example, side-panel position indicator 54 may be illuminated when side rails 18 and/or side rails 20 are raised. Further, for example, bed height indicator 56 may be illuminated when system 10 is in a lowermost position. Additionally, for example, patient-exit indicator 58 may be illuminated when system 10 is deemed to be in a configuration suitable for a patient to be moved onto or off of system 10. Also, for example, brake indicator 52, side-panel position indicator 54, bed height indicator 56, patient-exit indicator 58, and/or backrest-inclination indicator 59 may be of a type that illuminate in different colors (for example, they may be illuminated red when an associated feature of system 10 is not in an inputted or indicated configuration, or green when an associated feature of system 10 matches an inputted or indicated configuration). Also, for example, brake indicator 52, side-panel position indicator 54, bed height indicator 56, patient-exit indicator 58, and/or backrest-inclination indicator 59 may be configured to illuminate only at times when the bed is sensed to have been actuated into a configuration associated with those indicators. In tandem with indicators 52, 54, 56, 58, and/or 59 being illuminated, light unit 40 may also be illuminated to provide a consistent notification to attending personnel based on the illumination of the indicators (e.g., light unit 40 disposed on any portion of indicator device 30 may be illuminated to provide notification to attending personnel located at a significant distance away from system 10).

Figure 4:
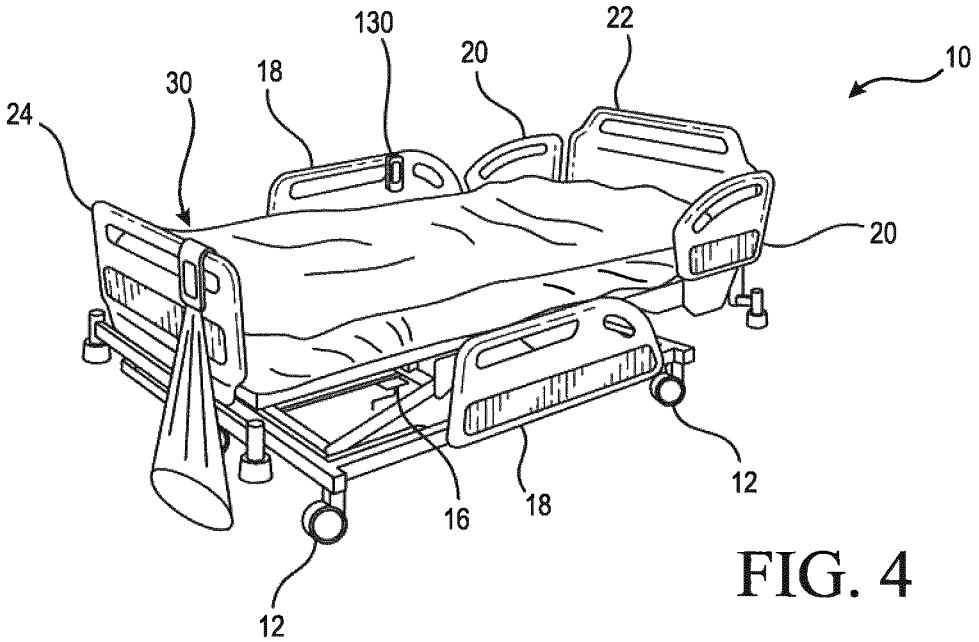
FIG. 4 is a perspective view of an exemplary system with an exemplary indicator device indicating a suitable configuration.

FIG. 4 illustrates an exemplary configuration of system 10 deemed suitable for a user such as, for example, a stable patient (e.g., a relatively healthy patient who is able to maintain a position on system 10). In addition to indicator device 30 and/or indicator device 30*a*, a second indicator device 130 may be provided that may be positioned for use by a patient utilizing system 10. Accordingly, a patient may be allowed to use indicator device 130 to control and/or provide input to system 10 similarly to as described above with reference to indicator device 30 and indicator device 30*a*. Also, for example, a patient may be provided instead with a different controller configured to control some features of system 10, but not all of the features described above with reference to indicator device 30 and indicator device 30*a*. Further, for example, a patient may be provided with no indicator device or controller for controlling system 10.

In the configuration illustrated in FIG. 4, light unit 40 may emit a green light indicative of an appropriate configuration (e.g., a suitable bed configuration), for example with frame 16 being in a lowered position, brakes 14 being applied, and at least one of side rails 18 and side rails 20 being in a lowered position. Also, for example, indicator device 30 and/or indicator device 130 may indicate that system 10 is in a suitable or appropriate configuration when only one of (for example, each of) side rails 18 and side rails 20 is lowered and the other is raised, only side rails or side panels on one side of system 10 are lowered, both side rails 18 and side rails 20 are lowered, or all side rails on all sides of system 10 are lowered (e.g., when system 10 is in a lowered position, for example). Also, for example, indicator device 30 may be configured to emit a warning sound when system 10 is in this configuration, serving as a notification to medical personnel or attending personnel such as a care giver that a patient has initiated a given configuration and therefore the patient's use of system 10 should possibly be monitored. Accordingly, indicator device 30 (and/or indicator device 30*a* and indicator device 130) may provide functionality by allowing system 10 to be set into a configuration (e.g., by using input unit 46) in which one or more of the features of system 10 is, for example, lowered or otherwise deactivated. In particular, this setting may allow a user (e.g., who is physically able) to get off or onto system 10 when one or more of side rails 18 and/or side rails 20 is lowered without indicator 30 providing notification (e.g., notification of an inappropriate configuration by providing illumination as described above or by raising an alarm). Further, system 10 may help to substantially prevent a patient who is relatively unstable or not physically able from climbing off of system 10 (e.g., by providing notification to attending personnel via indicator device 30).

Figure 5:
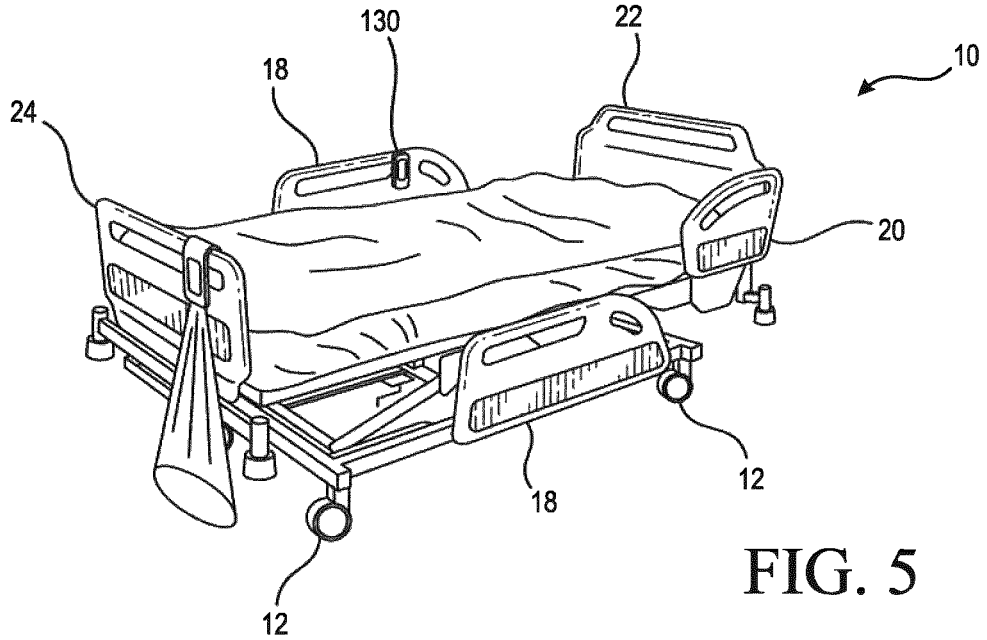
FIG. 5 is perspective view of an exemplary system with an exemplary indicator device indicating an unsuitable configuration.

FIG. 5 illustrates a similar configuration of system 10 as FIG. 4, but with indicator device 30 being set for a patient who is relatively unstable (e.g., relatively unhealthy or not physically able). For example, this configuration may be associated with a configuration of system 10 in which third input device 64 has been activated. In this setting, light unit 40 may emit a warning light (for example, a red or amber illumination notifying attending personnel that one or more of side rails 18 and/or side rails 20 is in a lowered position, because there is a patient who is not physically stable in system 10). Indicator device 30 may cause light unit 40 to emit a green light (e.g., or other color indicating for example suitability) when it is determined that: brakes 14 are applied, frame 16 is in a lowered position (e.g., a lowermost position), the majority of side rails 18 and side rails are in raised positions (e.g., at least three out of four of side rails 18 and side rails 20), and an exit alarm is activated (e.g., an audio warning device included, for example, as part of indicator device 30, frame 16, and/or any other suitable portion of system 10). For example, in the case in which system 10 is a bed such as a hospital bed, indicator device 30 may cause light unit 40 to emit a green light only, for example, when system 10 is sensed to be in an appropriate setting for a physically unstable patient (e.g., all of the appropriate features suitable to be activated for that patient are activated).

FIG. 6 illustrates an exemplary system 10*b*. System 10*b* may be a system for assisting a user's movement in a hospital or other care facility such as, for example, a patient lifting system or a patient hoist. System 10*b* may be, for example, a lifting device for assisting a patient into or out of a bed or other piece of equipment.

Exemplary system 10*b* may include a mast 70*b* that may be mounted on a chassis 72*b*. Chassis 72*b* may include a plurality of chassis legs 73*b* for stabilizing system 10*b* (e.g., stabilizing legs). A plurality of casters 74*b* may be mounted on chassis 72*b*, for example at distal ends of legs 73*b*, allowing users and/or attending personnel to move system 10*b* as desired. Brakes 76*b* may be disposed at respective casters 74*b* to selectively lock casters 74*b* and substantially prevent a movement of system 10*b*. A patient interface 78*b* (e.g., a patient support interface) may also be mounted to mast 70*b*, and may be used for securing a patient to system 10*b* during transport (e.g., via straps or other attachments for holding a patient). An indicator device 30*b* may be attached to any suitable portion of system 10*b*, such as a member 80*b* or handle. Indicator device 30*b* may be disposed at any other location of system 10*b* such as, for example, mast 70*b*, chassis 72*b*, or patient interface 78*b*. System 10*b* may also include one or more actuators 27*b*, sensors 29*b*, and a controller 35*b* that may operate generally similarly to actuators 27, sensors 29, and controller 35.

FIG. 7A illustrates exemplary indicator 30*b*. Indicator 30*b* may include a second display element 44*b* that may be generally similar to second display element 44*a*, and an input unit 46*b* that may be generally similar to input unit 46*a*. As illustrated in FIG. 7B, second display element 44*b* may include a plurality of indicators that may be generally similar to the indicators of second display element 44*a*. For example, second display element 44*b* may include a brake indicator 52*b* that may illuminate when brakes are applied (e.g., when brakes 76*b* are applied), an interface-loaded indicator 54*b* that may illuminate when a patient has been loaded on patient interface 78*b*, a mast-raised indicator 56*b* (e.g., a mast-height indicator) that may illuminate when mast 70*b* is extended or raised to a predetermined length or height (e.g., when mast 70*b* is raised to a height of, for example, 200 centimeters or more, 180 centimeters or more, 210 centimeters or more, or 220 centimeters or more), a chassis-legs-locked indicator 58*b* that may illuminate when chassis legs 73*b* are in a closed position (e.g., chassis legs 73*b* are in a closed and/or locked position that may further stabilize a vertical orientation of system 10*b*), a standstill-time indicator 59*b* that may illuminate when system 10*b* is in a stationary position for a predetermined amount of time (e.g., about 5 minutes, or about 10 minutes) but brakes 76*b* have not been activated, and an interface-connected indicator 61*b* that may illuminate when patient interface 78*b* is suitably connected to mast 70*b* (e.g., when a solid, reliable connection is made between patient interface 78*b* and mast 70*b*). For example, interface-connected indicator 61*b* may indicate that slings, safety belts and other components used to secure a patient to patient interface 78*b* are attached correctly (e.g., by illuminating to indicate suitability) or incorrectly (e.g., by illuminating to indicate unsuitability). Also, for example, second display element 44*b* may include a battery-status indicator 63*b* that may illuminate based on a battery level status of a power source of system 10*b* (e.g., illuminating to indicate suitability when battery power is sufficient and/or illuminating to indicate unsuitability when battery status is low). Brake indicator 52*b*, interface-loaded indicator 54*b*, mast-raised indicator 56*b*, chassis-legs-locked indicator 58*b*, standstill-time indicator 59*b*, interface-connected indicator 61*b*, and/or battery-status indicator 63*b* may provide attending personnel (e.g., a nurse or other care personnel) with an indication of the state of each of the configurable elements of system 10*b* (e.g., with respect to the activities of a patient or other user of system 10*b*). Brake indicator 52*b*, interface-loaded indicator 54*b*, mast-raised indicator 56*b*, chassis-legs-locked indicator 58*b*, standstill-time indicator 59*b*, interface-connected indicator 61*b*, and/or battery-status indicator 63*b* may provide output based on a configuration of system 10*b* sensed by one or more sensors 29*b* and a patient type inputted to input unit 46*b*.

As illustrated in FIG. 7C, input unit 46*b* may include a first input device 60*b*, a second input device 62*b*, and a third input device 64*b* that may be generally similar to the input devices of input unit 46*a*. Similar to first input device 60, first input device 60*b* may be used by an operator to set parameters for system 10*b* when system 10*b* is not being moved between different locations or positions (e.g., in the case when system 10*b* is substantially stationary). For example, first input device 60*b* may be activated for a situation applicable to all users or patients (e.g., a universal setting, or an all-patient type setting). For example, when first input device 60*b* is activated, indicators 52*b*, 54*b*, 56*b*, 58*b*, 59*b*, 61*b*, and 63*b* may all illuminate to indicate a suitable condition (e.g., green) to attending personnel or may not be illuminated at all. Also, for example, when first input device 60*b* is activated, brake indicator 52*b* may illuminate as unsuitable (e.g., red or other color denoting unsuitability) when brakes 76*b* are off (e.g., and brake indicator 52*b* may illuminate as suitable when brakes 76*b* are on and system 10*b* is locked in a substantially stationary position). Also, for example, battery-status indicator 63*b* may illuminate as unsuitable when a battery or power source of system 10*b* is low and may illuminate as suitable when a battery or power source of system 10*b* has sufficient reserve power.

Second input device 62*b* may work in conjunction with indicators 52*b*, 54*b*, 56*b*, 58*b*, 59*b*, 61*b*, and/or 63*b* in a manner similar to second input device 62 and the indicators of second display element 44*a*. For example, when second input device 62*b* is activated (e.g., for a user who is in generally good or fair physical condition), indicators 52*b*, 54*b*, 56*b*, 58*b*, 59*b*, 61*b*, and/or 63*b* may generally remain in a suitable configuration (e.g., illuminating green or other color denoting suitability), or may not be illuminated at all, except in a number of situations. For example, when second input device 62*b* is activated, brake indicator 52*b* may be illuminated as unsuitable (e.g., red or other color denoting unsuitability) when all brakes 76*b* are off, mast-raised indicator 56*b* may be illuminated as unsuitable when a certain length or height is exceeded (e.g., when the height is in excess of 200 cm, in excess of 220 cm, or in excess of 240 cm, for example), and interface-connected indicator 61*b* may be illuminated as unsuitable when one or more sensors 29*b* detect that a reliable connection has not been established. Also, for example, battery-status indicator 63*b* may illuminate as unsuitable when a battery or power source of system 10*b* is low and may illuminate as suitable when a battery or power source of system 10*b* has sufficient reserve power.

Third input device 64*b* may work in conjunction with indicators 52*b*, 54*b*, 56*b*, 58*b*, 59*b*, 61*b*, and/or 63*b* in a manner similar to third input device 64 and the indicators of second display element 44*a*. For example, when third input device 64*b* is activated (e.g., for a user who is in generally poor physical condition), indicators 52*b*, 54*b*, 56*b*, 58*b*, 59*b*, 61*b*, and/or 63*b* may illuminate in a suitable configuration (e.g., illuminating green or other color denoting suitability) in only a number of situations. For example, when third input device 64*b* is activated, brake indicator 52*b* may be illuminated as suitable when (e.g., green or other color denoting suitability) when all brakes 76*b* are on, interface-loaded indicator 54*b* may be illuminated to alert attending personnel (e.g., as yellow or some other suitable color denoting that particular attention should be paid) whenever a patient is loaded on patient interface 78*b*, mast-raised indicator 56*b* may be illuminated as unsuitable when a certain length or height is exceed (e.g., when the height is in excess of, for example, 160 cm, 180 cm, or 200 cm), standstill-time indicator 59*b* may be illuminated as suitable when system 10*b* has remained stationary but brakes 76*b* have not been applied for less than a predetermined amount of time (also, e.g., after one minute, two minutes, four minutes, five minutes, 10 minutes, or some other predetermined time interval, the illumination may change from suitable to unsuitable), and interface-connected indicator 61*b* may be illuminated as unsuitable when one or more sensors 29*b* detect that a reliable connection has not been established. Also, for example, when third input device 64*b* is activated, chassis-legs-locked indicator 58*b* may be illuminated as suitable when chassis legs 73*b* are closed or locked in position to increase the stability of system 10*b*. For most or all other configurations of system 10*b* when third input device 64*b* is activated, one or more indicators 52*b*, 54*b*, 56*b*, 58*b*, 59*b*, 61*b*, and/or 63*b* may be illuminated to indicate an unsuitable configuration (e.g., reflecting the generally more demanding parameters associated with a relatively weak or frail patient), and light unit 40 may also be illuminated to similarly indicate an unsuitable configuration. Also, for example, battery-status indicator 63*b* may be illuminated to indicate an unsuitable configuration when a battery or power source of system 10*b* is low and may illuminate as suitable when a battery or power source of system 10*b* has sufficient reserve power. In tandem with indicators 52*b*, 54*b*, 56*b*, 58*b*, 59*b*, 61*b*, and/or 63*b* being illuminated, light unit 40 may also be illuminated to provide a consistent notification to attending personnel based on the illumination of the indicators (e.g., light unit 40 disposed on any portion of indicator device 30*b* may be illuminated to provide notification to attending personnel located a significant distance away from system 10*b*).

The exemplary disclosed device and system may provide an indicator device 30 that can be positioned in various locations on a system 10, for example suitably within view of attending personnel such as medical personnel or caretakers who are not in immediate or close vicinity of the system. The exemplary disclosed device and system may also provide a setting function that gives an indication of suitability (e.g., based on user attributes such as, for example, patient health) when one or more of the features of system 10 is in a deactivated condition (e.g., when one or more side rails 18 or side rails 20 is lowered to enable the patient to get into or off system 10 unaided, or when a frame 16 is in a lowered or lowermost position). Also for example, system 10 may provide an integrated notification system that provides individual monitoring of various parameters as well as monitoring and indication of an overall system status.

It is contemplated that any number or combination of appropriate system features may be provided in conjunction with exemplary disclosed system 10, depending on a functionality of various exemplary embodiments of system 10. For example, system 10 may have a plurality of configurations suitable for various types or categories of patients.

It is contemplated that the above-disclosed exemplary features may be combined with one another in any suitable manner. It will be apparent to those skilled in the art that various modifications and variations can be made to the disclosed method and apparatus. Other embodiments will be apparent to those skilled in the art from consideration of the specification and practice of the disclosed method and apparatus. It is intended that the specification and the disclosed examples be considered as exemplary only, with a true scope being indicated by the following claims.

What is claimed is:

1. A patient handling apparatus comprising:

a plurality of casters and one or more brakes selectively braking the plurality of casters;

one or more sensors detecting a configuration of the patient handling apparatus;

and an indicator device operatively associated with the one or more sensors, the indicator device comprising:

a user interface allowing input of patient type information; and an indicator that issues a status notice based on the entered patient type information and the detected configuration of the patient handling apparatus sensed by the one or more sensors;

wherein the indicator device is configured as a portable, hand-held device detachably coupled to one or more portions of the patient handling apparatus, wherein the indicator is a system status indicator that provides a status notice of the patient handling apparatus, wherein the patient handling apparatus is a bed, wherein the one or more sensors include a brake sensor that detects whether the plurality of casters are locked by the one or more brakes, a bed height positioning sensor, and a bed exit sensor, and wherein the indicator includes a patient-exit indicator for indicating suitability for a patient to leave the bed based on a frame of the bed being in a lowest position.

2. The patient handling apparatus of claim 1, wherein the indicator device further comprises an adjustable hook that is detachably mounted to multiple portions of the patient handling apparatus.

3. The patient handling apparatus of claim 1, wherein the indicator device is wirelessly coupled or connected by a cable to the one or more portions of the patient handling apparatus.

4. The patient handling apparatus of claim 1, wherein the patient type information is a stable patient type or an unstable patient type.

5. The patient handling apparatus of claim 1, wherein the patient type information relates to a degree of patient mobility.

6. The patient handling apparatus of claim 1, wherein the status notice is a suitable-for-patient status notice or an unsuitable-for-patient status notice.

7. The patient handling apparatus of claim 1, wherein the system status indicator is configured as a light element and/or an audio device.

8. The patient handling apparatus of claim 1, wherein the system status indicator is configured as one or more light elements disposed at a distal end of the indicator device and are oriented and configured to direct emitted light towards a ground surface for reflection.

9. The patient handling apparatus of claim 1, wherein the indicator is a brake indicator that issues a brake status notice.

10. The patient handling apparatus of claim 1, wherein the indicator is a power source status indicator indicating a status of a power source of the patient handling apparatus.

11. The patient handling apparatus of claim 1, wherein the patient handling device is selected from the group consisting of: a bed, a patient lift, a patient trolley and a patient standing aid.

12. The patient handling apparatus of claim 1, wherein the one or more sensors further includes at least one of: a power source sensor, a side rail positioning sensor, a backrest positioning sensor, a mattress pressure sensor, a patient support air flow sensor, an inflatable mattress therapy sensor, a bed adjustment sensor, and any combination thereof.

13. The patient handling apparatus of claim 1, wherein the patient handling apparatus further comprises a patient lift and the one or more sensors further include at least one of: a power source sensor, a sling attachment sensor, a load sensor, a brake sensor, a sling positioning sensor and any combination thereof.

14. The patient handling apparatus of claim 1, wherein the indicator device further comprises one or more component indicators corresponding to the one or more sensors.

15. The patient handling apparatus of claim 14, wherein the one or more indicators are configured as light elements that emit light when a detected feature of the patient handling apparatus is in an undesired state for the entered patient type information.

16. The patient handling apparatus of claim 15, wherein the light elements are disposed at a distal end of the indicator device and are oriented and configured to direct emitted light towards a ground surface for reflection.

17. A bed system, comprising:

a bed;

a plurality of casters and one or more brakes selectively braking the plurality of casters;

a sensor disposed at the bed; and an indicator device mountable to the bed, the indicator device comprising:

an input device that inputs a patient type to the indicator device; and an indicator that outputs a status to a user;

wherein the indicator outputs the status to the user based on:

the patient type; and a configuration of the bed that is detected by the sensor; and wherein the indicator device is configured as a portable, hand-held device detachably coupled to one or more portions of the bed, wherein the indicator is a system status indicator that provides a status notice of the bed system, wherein the sensor includes a brake sensor that detects whether the plurality of casters are locked by the one or more brakes, a bed height positioning sensor, and a bed exit sensor, and wherein the indicator includes a patient-exit indicator for indicating suitability for a patient to leave the bed based on input from the brake sensor and the bed height positioning sensor, and based on a frame of the bed being in a lowest position.

18. The bed system of claim 17, further comprising: an actuator disposed at the bed, wherein the actuator adjusts an angle of an upper portion of the bed from a horizontal plane, the sensor senses the angle of the upper portion of the bed from the horizontal plane, and the indicator is a bed inclination indicator.

19. The bed system of claim 17, further comprising: an actuator disposed at the bed, wherein the actuator adjusts a height of the bed from a floor, the sensor senses the height of the bed from the floor, and the indicator is a bed height indicator.

20. The bed system of claim 17, wherein the patient type is an all-patient type, a stable patient type, or an unstable patient type.

21. The bed system of claim 17, further comprising a side rail disposed on the bed, wherein the sensor senses whether or not the side rail is raised in an upright position, and the indicator is a side-panel position indicator.

22. The bed system of claim 17, wherein the sensor detects if a patient has exited the bed, and the indicator is a patient-exit indicator.

23. The bed system of claim 17, further comprising a first light unit disposed on the indicator device and a second light unit included in the indicator, wherein the first light unit and the indicator illuminate in a first color indicating a suitable-for-patient status or in a second color indicating an unsuitable-for-patient status.

* * * * *